United States Patent [19]

Brown

[11] Patent Number: 4,827,968

[45] Date of Patent: May 9, 1989

[54] CHECK VALVE FOR AN ELECTROMAGNETIC FLUID PUMP HAVING A DUAL VALVE SEAT

[75] Inventor: Ralph V. Brown, Cayuta, N.Y.

[73] Assignee: Facet Enterprises, Inc., Tulsa, Okla.

[21] Appl. No.: 145,546

[22] Filed: Jan. 19, 1988

[51] Int. Cl.[4] ..... F04B 17/04

[52] U.S. Cl. ..... 137/270; 417/417; 137/543.13

[58] Field of Search ..... 137/270, 269, 269.5, 137/543.13; 417/417

[56] References Cited

U.S. PATENT DOCUMENTS

| | | | |
|---|---|---|---|
| 2,767,730 | 10/1956 | Laird | 137/329.02 |
| 2,833,221 | 5/1958 | Dickey | 417/417 X |
| 3,366,067 | 1/1968 | Kocolowski | 417/417 |
| 3,400,663 | 10/1968 | Wertheimer | 417/417 |
| 4,086,518 | 4/1978 | Wilkinson | 417/417 X |
| 4,101,950 | 7/1978 | Hager | 417/417 X |

*Primary Examiner*—Alan Cohan
*Attorney, Agent, or Firm*—Remy J. VanOphem

[57] ABSTRACT

A check valve having a dual valve seat, a valve member, a retainer, and a valve spring. The dual valve seat has a cylindrical body having an axial bore therethrough. A conical valve seat is provided at one end of the axial bore and a flat valve seat is provided at the other end of the axial bore. A recess is provided in the face of the cylindrical body at the end having the conical valve seat to form a first retainer seat and an annular recess is provided about the flat valve seat to form a second retainer seat by inverting the valve seat, the check valve may accept either a stem valve member having a conical sealing surface or a flat valve member having a flat sealing surface. The embodiment of this check valve in an electromagnetic fluid pump permits it to have different operating characteristics depending on which valve member is used.

25 Claims, 2 Drawing Sheets

CHECK VALVE FOR AN ELECTROMAGNETIC FLUID PUMP HAVING A DUAL VALVE SEAT

BACKGROUND OF THE INVENTION

1. Field of the Invention

The invention is related to the field of electromagnetic pumps and, in particular, to an inlet check valve for controlling the direction of fluid flow through the pump.

2. Description of the Prior Art.

Electromagnetic fluid pumps conventionally have a conical inlet valve member which seats in a mating conical valve seat formed in the inlet housing. Typical use of such conical valve members are in the "reciprocating plunger pump" disclosed by Wertheimer in U.S. Pat. No. 3,400,663 and the "on demand pump" disclosed by Wilkinson in U.S. Pat. No. 4,086,518. Although inlet valves having conical valve members and conical valve seats function well for most applications, this type of valve has poor anti-backflow characteristics and the pump will lose its prime shortly after its operation is terminated. In many applications, however, the pump is located above the fluid source, and the loss of prime after the operation of the pump is terminated is undesirable and having to re-prime the pump is a nuisance. When such pumps are used in a continuous mode, the loss of electrical power for a period long enough for the pump to lose its prime could result in a dangerous condition.

To eliminate this problem, it has been found that flat elastomeric inlet valves have superior anti-backflow characteristics and eliminate the problems encountered with the conical valve members. A typical example of the use of such a flat elastomer inlet valve is in the portable fluid transfer pump disclosed by Hager et al in U.S. Pat. No. 4,101,950. The problem with the flat elastomer inlet valve is that the valve is slightly less efficient than if it had a conical valve. As a result of these varying requirements, the manufacturer is required to make two different pumps to meet the needs of the different applications.

The invention is a solution to this problem which permits the manufacturer to manufacture a single pump structure capable of accepting either a flat elastomeric valve member or a conical valve member.

SUMMARY OF THE INVENTION

The invention is a check valve for a fluid pump of the type having an inlet port, an outlet port, a cylindrical passageway connecting the inlet port with the outlet port, a reciprocating piston disposed in the cylindrical passageway, and a piston return spring for biasing the piston away from the inlet port. The check valve has a dual valve seat. The dual valve seat has a cylindrical body, a conical valve seat provided at one end of the cylindrical body, and an annular flat valve seat porvided at the opposite end thereof. The cylindrical body is receivable in the cylindrical passageway of the fluid pump with one of the conical valve seat and the flat valve seat facing away from the inlet port. The check valve also includes a valve member having a sealing surface mating with the one valve seat facing away from the inlet port, a cup-shaped retainer disposed over the valve member and held against the dual valve seat by the piston return spring, and a valve spring disposed between the bottom of the cup-shaped retainer and the valve member to resiliently bias the valve member against the valve seat facing away from the inlet port.

The advantage of the check valve having the dual valve seat is that it eliminates the requirement for making two different inlet housings which substantially reduces the cost of making two different types of pumps. Another advantage is that the dual valve seat can be molded from a structural plastic, eliminating the need for more expensive machining of the inlet housing. Another advantage of the check valve is that when embodied in a fluid pump it can be converted in the field from one type to another by simply reversing the dual valve seat and inserting a proper valve member. These and other advantages of the disclosed check valve having a dual valve seat member shall become obvious from a reading of the detailed description of the invention in conjunction with the appended drawings.

DETAILED DESCRIPTION OF THE INVENTION

Figure 1:
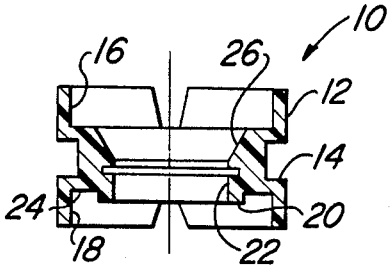
FIG. 1 is a cross-sectional view of the dual valve seat.

The invention is a check valve having a reversible dual valve seat 10 as is shown in FIG. 1. The valve seat 10 has a generally cylindrical body portion 12 having an "O" ring groove 14 provided between its opposite ends. The body portion 12 has a counterbore 16 provided at one end and a like counterbore 18 provided at its opposite end. A raised annular flat valve seat 20 is formed at the bottom end of the counterbore 18 between an axial bore 22 and an annular recess 24. A conical bore is provided at the bottom of the counterbore 16 which forms a conical valve seat 26 for a conical stem valve member as shall be discussed relative to FIG. 3. In its preferred embodiment, the dual valve seat 10 is molded from a structural plastic, such as Ryton® manufactured by DuPont, however, it may be machined from a metal or other suitable material.

Figure 2:
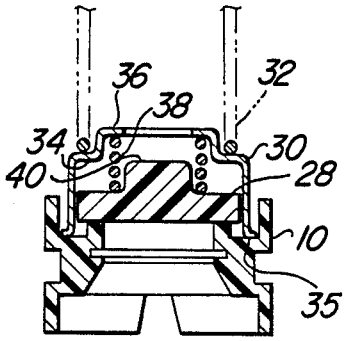
FIG. 2 is a cross-sectional view of a check valve with a flat valve member seated against the flat valve seat.

Referring now to FIG. 2 there is shown an enlarged view of a check valve having the dual valve seat 10 in combination with a resilient flat valve member 28 and a cup-shaped retainer 30. The retainer is resiliently biased against the bottom of the annular recess 24 by a piston return spring 32. The piston return spring 32 seats on a shoulder 34 formed at the top of the cup-shaped retainer 30 and is laterally held in place by a boss 36. Alternatively, a radial lip 35 circumscribing the open end of the cup-shaped retainer 30 may also serve as a seat for the piston return spring 32 as discussed relative to the configuration shown in FIG. 3. With this configuration, the cup-shaped retainer may accommodate piston return springs of various diameters.

A valve spring 38 is disposed inside of the cup-shaped retainer 30 between the top of the boss 36 and the flat valve member 28 and produces a predetermined force biasing the flat valve member 28 against the flat valve seat 20. A spring retainer knob 40 provided on the top of the flat valve member 28 prevents the lateral displacement of the valve spring 38 relative to the flat valve member.

Figure 3:
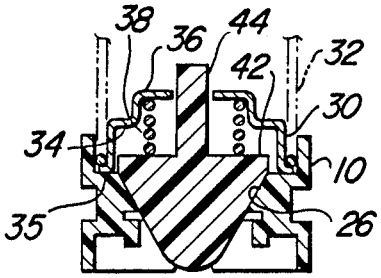
FIG. 3 is a cross-sectional view of a check valve with a conical valve member seated against the conical valve seat.

Referring now to FIG. 3 there is shown a check valve having the dual valve seat 10 inverted from the orientation shown in FIG. 2 and a conical or stem valve member 42 received in the conical valve seat 26. The retainer 30 is identical to the retainer 30 described with reference to the check valve shown in FIG. 2, and it is resiliently biased against the bottom of the counterbore 16 by the piston return spring 32 which seats against the radial lip 35. As discussed relative to FIG. 2, the valve spring 38 produces a force biasing the stem valve member 42 against the conical valve seat 26. A stem 44 of the stem valve member 42 protrudes through an aperture in the top of the cup-shaped retainer 30 and inhibits lateral displacement of the valve spring 38 relative to the stem valve member 42 to assure proper closing of the valve.

Figure 4:
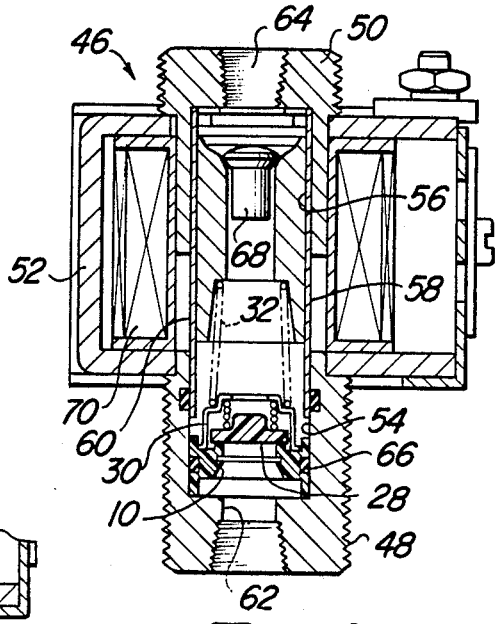
FIG. 4 is a cross-sectional view of an electromagnetic fluid pump having the check valve arrangement of FIG. 2.
Figure 6:
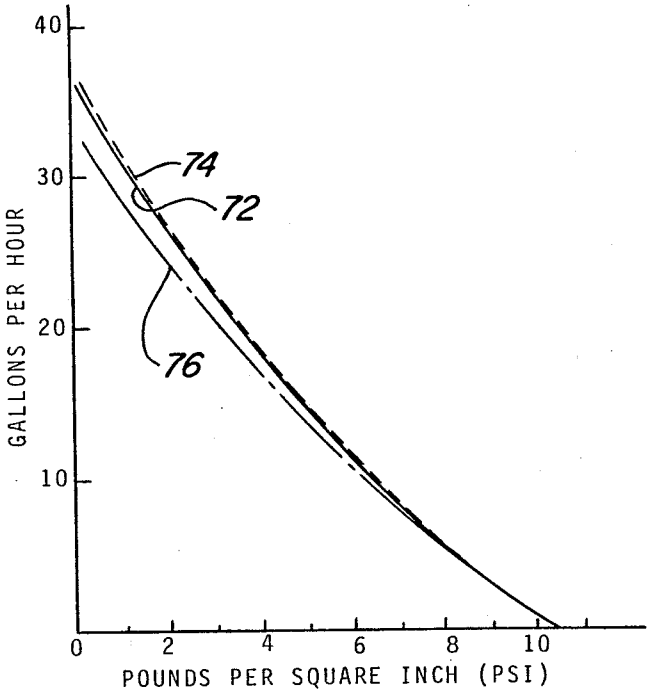
FIG. 6 is a graph showing the pumping efficiency of the pump with the dual valve seat in both configurations.

FIG. 4 shows the installation of the check valve, as shown in FIG. 2, in a typical electromagnetic fluid pump 46 of the type disclosed in Wertheimer in U.S. Pat. No. 3,400,663. The pump 46 has an inlet housing 48 having an axial inlet port 62 and an outlet housing 50 having an axial outlet port 64. The inlet housing 48 and the outlet housing 50 are threadably attached to a U-shaped bracket 52 which supports them concentrically with one another. The inlet housing 48 has a first axial bore 54 and the outlet housing 50 has a like axial bore 56. A nonmagnetic cylindrical member 58 is received in the axial bores 54 and 56 and forms a guide for a hollow magnetically susceptible piston 60. The check valve having the dual valve seat 10 is disposed at the bottom of the axial bore 54 adjacent to the axial inlet port 62. In this embodiment, the dual valve seat is oriented as shown in FIG. 2 and the flat elastomer valve member 28 is seated against the flat valve seat 20. The cup-shaped retainer 30 is biased against the dual valve seat 10 by the compressed piston return spring 32 as previously discussed. The force of the compressed piston spring is sufficient to hold the cup-shaped retainer 30 against the dual valve seat 10 and to hold the dual valve seat 10 at the bottom of the axial bore 54. An "O" ring 66 is disposed in the "O" ring groove 14 of the dual valve seat 10 and forms a fluid tight seal between the walls of the axial bore 54 and the external surface of the body portion 12 of the dual valve seat. A pintle type valve member 68 is disposed at the end of the piston 60 adjacent to the axial outlet port 64 which in conjunction with the flat valve member provides for unidirectional fluid flow through the pump 46 with the reciprocation of the piston 60. A solenoid coil 70 circumscribes the outlet housing 50 adjacent to the piston 60 which is periodically energized to displace the piston 60 towards the axial inlet port 62. In this configuration the pump has insufficient backflow and will retain its prime for extended periods of time. However, its pumping efficiency is somewhat reduced as is shown in FIG. 6.

Figure 5:
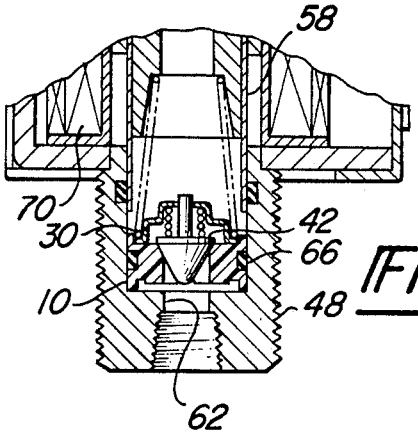
FIG. 5 is a partial cross-sectional view of the same electromagnetic pump having the check valve arrangement of FIG. 3.

If in the intended application backflow or loss of prime is not a problem, the dual valve seat 10 may be turned over and the flat valve member replaced with a stem valve member 42 having a conical sealing surface as shown in FIG. 5. Effectively, the pumps shown in FIGS. 4 and 5 are identical except for the valve member. This represents a significant simplification of the manufacture of the pump since the same inlet housing can be used for both configurations rather than having two different inlet housings. Another advantage of the dual valve seat is that it can be molded to the desired shape eliminating the expensive (close tolerance) machining of the inlet housing to form the valve seat. Another advantage of the dual valve seat is that it permits the pump to be changed from one kind to another in the field by simply inverting the dual valve seat and replacing the valve member with one having the appropriate configuration.

The use of a check valve having the dual valve seat 10 does not substantially change the pumping characteristics of the pump. FIG. 6 is a graph showing the output fluid pressure of the pump as a function of the fuel delivery rate in gallons per hours (G.P.H.). The solid line 72 shows the pressure verses fluid delivery rate of a standard electromagnetic fluid pump of the type disclosed by Wertheimer as discussed above. The dashed line 74 represents the fluid pressure verses delivery rate for the same type of pump having a dual valve seat and a stem valve member. The dash dot line 76 represents the fluid pressure verses delivery rate for the same type of pump in which the check valve includes a dual valve seat and a flat valve member. The data presented in FIG. 6 is the average data taken from 15 pumps of each type.

Figure 7:
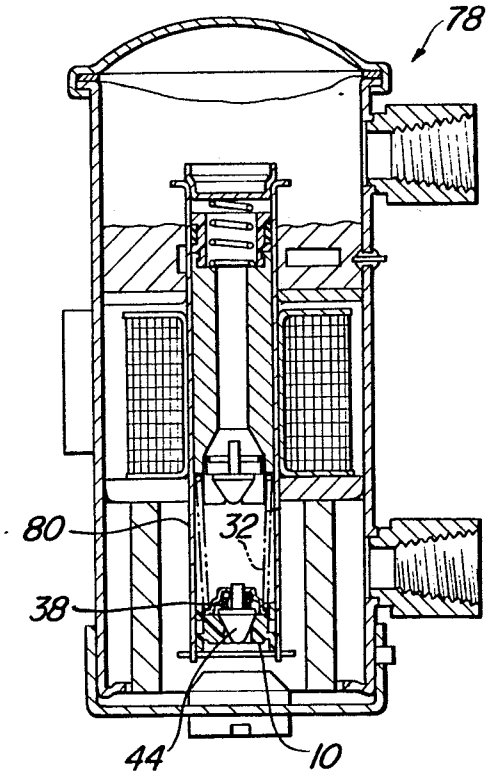
FIG. 7 is a cross-sectional view of an electromagnetic fluid pump of a different configuration using the check valve as shown in FIG. 3.

The check valve having the dual valve seat is not limited to any particular type of electromagnetic fluid pump. As shown in FIG. 7, a check valve having a dual valve seat and the associated member may be used with alternate fluid pump configurations 78 such as that disclosed by Wiernicki in U.S. Pat. No. 4,413,950.

In this pump configuration, the check valve is oriented as shown in FIG. 3 and is seated at the bottom of a nonmagnetic cylindrical piston guide 80. The check valve is held in place by the piston return spring 32 engaging the radial lip 35 at the open end of the cup-shaped retainer. As would be obvious to one skilled in the art, the dual valve seat 10 may be turned over from the position shown and the stem valve member 42 replaced with a flat valve member.

It is recognized that persons skilled in the art may make changes or alter the configuration of the dual valve seat without departing from the spirit of the invention as described above and set forth in the appended claims.

What is claimed is:

1. A check valve for a fluid pump of the type having an inlet port, an outlet port, a cylindrical passageway connecting said inlet port with said outlet port, a piston disposed in said cylindrical passageway and operative to reciprocate therein, and a piston return spring for producing a force biasing said piston away from said inlet port, said check valve comprising:

a dual valve seat member having a cylindrical body, an axial bore passing therethrough, a flat valve seat provided at one end of said axial bore and a conical valve seat provided at the other end of said axial bore, said cylindrical body being receivable in said cylindrical passageway with one of said flat and conical valve seats facing away from said inlet port;

a valve member having a sealing surface mating with said one of said flat and conical valve seats;

a cup-shaped retainer disposed over said valve member and held against the end of said cylindrical body by said piston return spring; and a valve spring disposed between the bottom of said cup-shaped retainer and said valve member to resiliently bias said valve member against said one of said flat and conical valve seats.

2. The check valve of claim 1, wherein said valve member is a stem valve having a conical sealing surface engaging said conical valve seat.

3. The check valve of claim 2, wherein said cylindrical body has a counterbore provided in said one end about said conical valve seat to form a first recessed retainer seat and wherein the open end of said cup-shaped retainer has a radial lip which seats against said first recessed retainer seat.

4. The check valve of claim 2, wherein said stem valve has a stem protruding from the surface opposite said conical sealing surface and wherein said valve spring circumscribes said stem.

5. The check valve of claim 1, wherein said valve member is a flat valve member having a flat surface engaging said flat valve seat.

6. The check valve of claim 5, wherein said cylindrical body has at said other end an annular recess provided about said axial bore to provide a second retainer seat at the bottom of said annular recess and wherein the open end of said cup-shaped retainer has a radial lip which is seated against said second retainer seat at the bottom of said annular recess.

7. The check valve of claim 5, wherein said flat valve member has an axially protruding knob provided on its side opposite said flat surface and wherein said valve spring circumscribes said axial knob.

8. The check valve of claim 1, wherein said cylindrical body has an "O" ring groove provided about its periphery.

9. The check valve of claim 8 having an "O" ring disposed in said "O" ring groove to provide a fluid tight seal between said check valve and the internal surface of said cylindrical passageway.

10. The check valve of claim 1, wherein the bottom of said cup-shaped retainer is a seat for said piston return spring.

11. The check valve of claim 10, wherein said cup-shaped retainer has a boss protruding from the bottom thereof, said boss being circumscribed by said piston return spring and inhibiting lateral displacement thereof from the bottom of said cup-shaped retainer.

12. The check valve of claim 11, wherein said valve spring seats in the bottom of said boss protruding from the bottom of said cup-shaped retainer.

13. The check valve of claim 1, wherein the open end of said cup-shaped retainer has a radial lip and said piston return spring seals against said radial lip.

14. A check valve comprising:

a dual valve seat having a cylindrical body, an axial bore therethrough, a flat valve seat provided at one end of said axial bore, and a conical valve seat provided at the other end of said axial bore;

a cup-shaped retainer having an open end and a bottom end, said open end engaging said dual valve seat adjacent to one of said flat and said conical valve seats;

a valve member having a sealing surface mating with said one of said flat and conical valve seats and a top surface; and a compressed valve spring having one end engaging said bottom end of said cup-shaped retainer and the other end engaging said top surface of said valve member to hold it against said one of said flat and conical valve seats.

15. The check valve of claim 14, wherein said valve member is a conical valve member having a conical sealing surface mating with said conical valve seat.

16. The check valve of claim 15, wherein said conical valve member is a stem valve having an axial stem extending away from said conical sealing surface and wherein said compressed valve spring is a coil spring which circumscribes said stem to prevent lateral displacement therebetween.

17. The check valve of claim 14, wherein a counterbore is provided in the end surface of said cylindrical body having said conical valve seat to provide a recessed seat for said cup-shaped retainer to prevent lateral displacement therebetween.

18. The check valve of claim 14, wherein said valve member is a flat valve member having a flat sealing surface mating with said flat valve seat.

19. The check valve of claim 18, wherein said flat valve member has an axially protruding knob provided on the side opposite said flat sealing surface and said compressed valve spring is a conical spring circumscribing said axially protruding knob to prevent lateral displacement therebetween.

20. The check valve of claim 14, wherein said cylindrical body has an "O" ring groove provided about its periphery.

21. The check valve of claim 14, wherein said cup-shaped retainer has a stepped shoulder intermediate said open end and said bottom end providing a spring seat for a coil spring which resiliently biases said cup-shaped retainer against said dual valve seat.

22. The check valve of claim 21, wherein said cup-shaped retainer further has a radial lip circumscribing said open end to form an alternate seat for said coil spring.

23. A dual valve seat for a check valve of the type having a valve seat, a valve member engaging said valve seat, a retainer and a valve spring for biasing said valve member against said valve seat, said dual valve seat comprising:

a cylindrical body having an axial bore passing therethrough;

a conical valve seat provided at one end of said axial bore;

a flat valve seat provided at the other end of said axial bore;

a counterbore provided at said one end of said cylindrical body to form a first recessed retainer seat; and an annular recess provided at the other end of said cylindrical body about the periphery of said flat valve seat and concentric with said axial bore to form a second recessed retainer seat;

whereby reversing the position of said cylindrical body relative to said valve member and said retainer and using a valve member whose sealing surface mates with the valve seat converts said check valve from one type to another.

24. A check valve for a fluid pump of the type having an inlet port, an outlet port, a cylindrical passageway connecting said inlet port with said outlet port, a piston disposed in said cylindrical passageway and operative to reciprocate therein, and a piston return spring for producing a force biasing said piston away from said inlet port, said check valve comprising:

a dual valve seat member having a cylindrical body, an axial bore passing therethrough, a flat valve seat provided at one end of said axial bore and a conical valve seat provided at the other end of said axial bore, said cylindrical body being receivable in said cylindrical passageway with one of said flat and conical valve seats facing away from said inlet port;

a valve member having a flat sealing surface mating with said flat valve seat of said dual valve seat member;

a cup-shaped retainer disposed over said flat valve member and held against one end of said cylindrical body by said piston return spring; and a valve spring disposed over said cup-shaped retainer member and said flat valve seat to resiliently bias said valve member against said flat valve seat of said dual valve seat member.

25. A check valve for a fluid pump of the type having an inlet port, an outlet port, a cylindrical passageway connecting said inlet port with said outlet port, a piston disposed in said cylindrical passageway and operative to reciprocate therein, and a piston return spring for producing a force biasing said piston away from said inlet port, said check valve comprising:

a dual valve seat member having a cylindrical body, an axial bore passing therethrough, a flat valve seat provided at one end of said axial bore and a conical valve seat provided at the other end of said axial bore, said cylindrical body being receivable in said cylindrical passageway with one of said flat and conical valve seats facing away from said inlet port;

a conical stem valve member having a conical sealing surface mating with said conical valve seat;

a cup-shaped retainer surrounding said conical stem valve member with said stem protruding therefrom, said cup-shaped retainer being held against the end of said cylindrical body by said piston return spring; and a valve spring disposed between said cup-shaped retainer and said conical stem valve member to resiliently bias said conical stem valve member against said conical valve seat of said dual valve seat member.

* * * * *

UNITED STATES PATENT AND TRADEMARK OFFICE

CERTIFICATE OF CORRECTION

PATENT NO. : 4,827,968

DATED : May 9, 1989

INVENTOR(S) : Ralph V. Brown

It is certified that error appears in the above-identified patent and that said Letters Patent is hereby corrected as shown below:

Column 3, line 53, delete "pintle type" and insert ---- pintle-type ----.

Column 5, line 35, delete "axial" and insert ---- axially protruding ----.

Signed and Sealed this

Fifth Day of June, 1990

*Attest:*

HARRY F. MANBECK, JR.

*Attesting Officer*

*Commissioner of Patents and Trademarks*